US007219645B2

(12) United States Patent
Lamb et al.

(10) Patent No.: US 7,219,645 B2
(45) Date of Patent: May 22, 2007

(54) OIL PUMP FOR A MOTORCYCLE

(75) Inventors: Charles J. Lamb, Greendale, WI (US); Jesse Dees, Slinger, WI (US)

(73) Assignee: Harley-Davidson Motor Company Group, Inc., Milwaukee, IL (US)

( * ) Notice: Subject to any disclaimer, the term of this patent is extended or adjusted under 35 U.S.C. 154(b) by 0 days.

(21) Appl. No.: 11/424,083

(22) Filed: Jun. 14, 2006

(65) Prior Publication Data

US 2007/0000470 A1 Jan. 4, 2007

Related U.S. Application Data

(60) Provisional application No. 60/696,384, filed on Jul. 1, 2005.

(51) Int. Cl.
*F01M 1/02* (2006.01)
*F02B 41/00* (2006.01)

(52) U.S. Cl. ..... 123/196 R; 123/198 C; 184/6.5

(58) Field of Classification Search ..... 123/196 R, 123/198 C; 184/6.5
See application file for complete search history.

(56) References Cited

U.S. PATENT DOCUMENTS

| | | | | |
|---|---|---|---|---|
| 3,023,847 | A * | 3/1962 | Kolbe | 123/196 R |
| 4,703,724 | A | 11/1987 | Candea et al. | |
| 5,092,292 | A | 3/1992 | Iguchi et al. | |
| 5,295,463 | A | 3/1994 | Wenger et al. | |
| 5,421,298 | A * | 6/1995 | Ming et al. | 123/198 C |
| 5,555,856 | A | 9/1996 | Bauer et al. | |
| 5,572,968 | A * | 11/1996 | Esch et al. | 184/6.5 |
| 6,047,667 | A | 4/2000 | Leppanen et al. | |
| 6,116,205 | A | 9/2000 | Troxler et al. | |
| 6,457,449 | B1 | 10/2002 | Troxler et al. | |

* cited by examiner

*Primary Examiner*—Noah P. Kamen
(74) *Attorney, Agent, or Firm*—Michael Best & Friedrich LLP

(57) ABSTRACT

An oil pump for an engine having a first cam shaft and a second cam shaft. The oil pump includes a housing and a first pump assembly at least partially disposed within the housing. The first pump assembly includes a rotating element that is adapted to be directly driven by the first cam shaft. A second pump assembly is at least partially disposed within the housing. The second pump assembly includes a rotating element that is adapted to be directly driven by the second cam shaft.

20 Claims, 6 Drawing Sheets

OIL PUMP FOR A MOTORCYCLE

RELATED APPLICATION DATA

This application claims priority to now abandoned U.S. Provisional Patent Application Ser. No. 60/696,384 filed on Jul. 1, 2005 and incorporated herein by reference.

BACKGROUND

The present invention relates to an oil pump assembly for a motorcycle. More particularly, the invention relates to an oil pump assembly that includes two pumping units that are each directly driven by a cam shaft.

Motorcycles generally include a front wheel and a rear wheel that rotate about separate axles as the motorcycle moves. An engine combusts a fuel-air mixture to produce shaft power that is directed to the rear wheel to propel the motorcycle. Many of the moving parts of the engine require a lubricant, such as oil, that both lubricates the moving parts and provides some cooling for the parts. To provide the necessary oil, the motorcycle includes an oil pump that is driven by the engine. In most constructions, a gear, belt or chain interconnects the pumping element or elements and a cam shaft or a crankshaft to provide power to the pump.

SUMMARY

The present invention provides an oil pump assembly for a motorcycle. The oil pump attaches to an engine that includes a crankcase, a crankshaft, and two cam shafts. The oil pump assembly includes a pump body that supports two gerotors for rotation. One of the gerotors draws oil from sumps within the crankcase and the cam chest and pumps the oil to an oil reservoir, while a second gerotor pumps the oil from the reservoir, through an oil filter, an oil cooler, and to the engine components that require lubrication. Each gerotor is directly driven by one of cam shafts.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
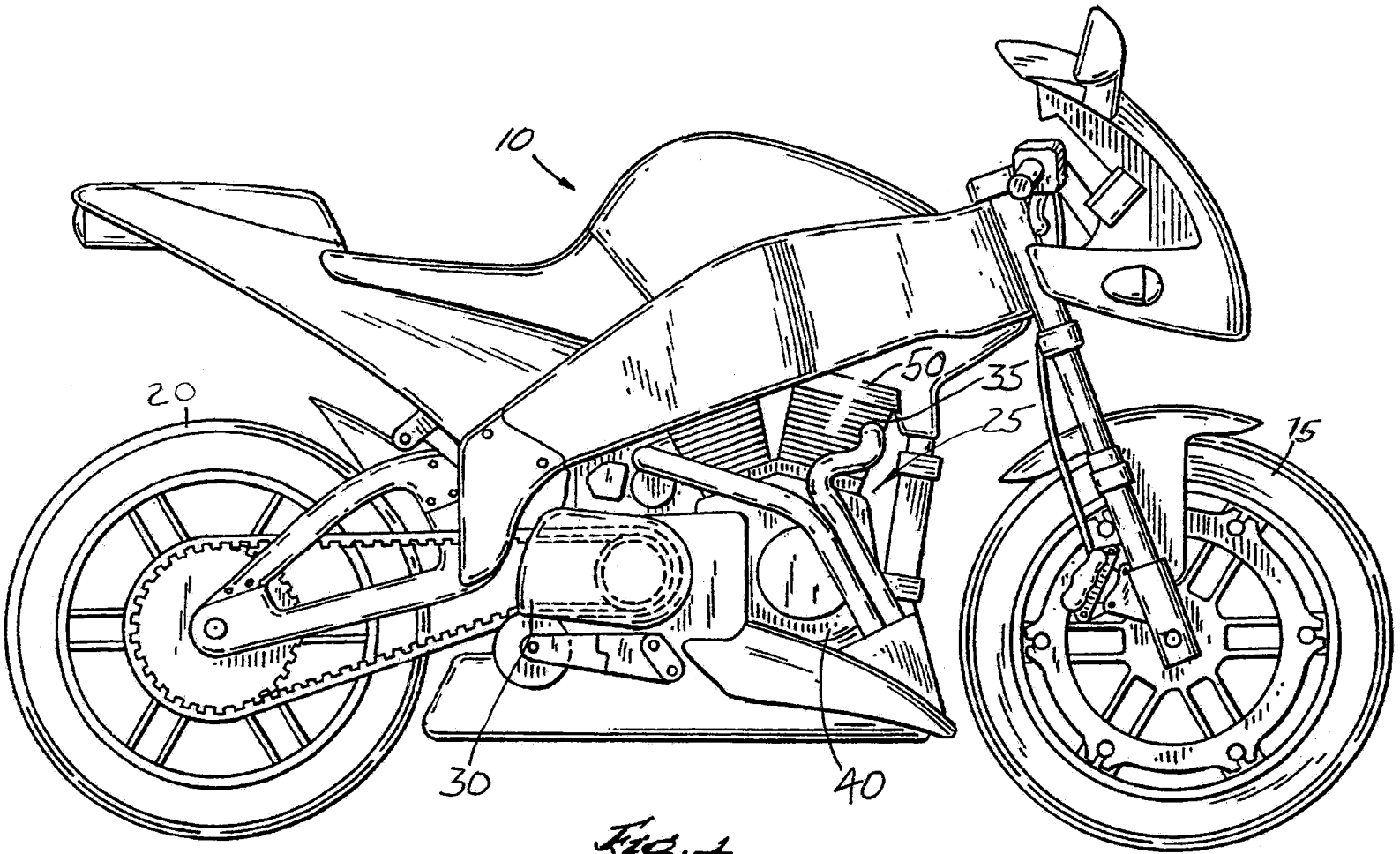
FIG. 1 is a perspective view of a motorcycle including an engine embodying the present invention.

FIG. 1 illustrates a motorcycle 10 that includes a front wheel 15, a rear wheel 20, an engine 25, and a transmission 30. The engine 25 combusts a fuel-air mixture to produce usable shaft power that in turn drives the rear wheel 20 to propel the motorcycle 10. Generally, a spark-ignition internal combustion engine 25 is employed to power the motorcycle 10. However, other constructions may include compression-ignition engines, rotary engines, or other types of engines that combust a fuel to produce usable shaft power.

Figure 2:
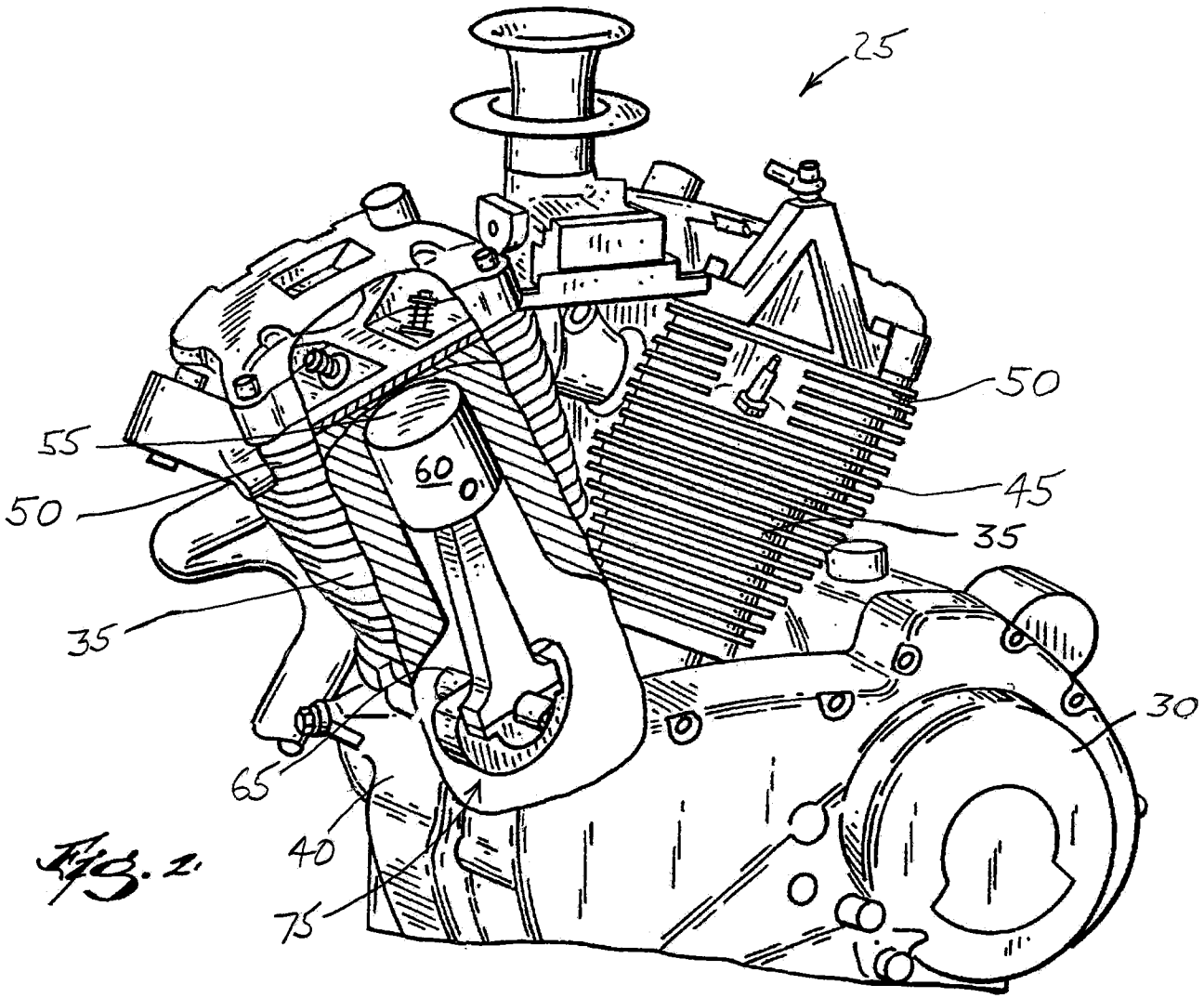
FIG. 2 is a partially broken away perspective view of the engine of FIG. 1.

FIG. 2 illustrates the engine 25 and transmission 30 of the motorcycle 10 of FIG. 1. The transmission 30 attaches to the engine 25 and extends rearward. The transmission 30 contains gearing or other components that allow for variation in the rotating speed of the rear wheel as compared to the rotating speed of the engine 25, as is well known.

The engine 25 includes two cylinders 35 that extend above a crankcase 40. Each cylinder 35 is angled slightly and includes a plurality of fins 45 that aid the cylinder 35 in cooling during engine operation. A cylinder head 50 is positioned on top of each cylinder 35 and cooperates with the cylinders 35 to define a combustion chamber 55. Pistons 60, disposed within each of the cylinders 35, reciprocate in response to combustion within the combustion chambers 55 to rotate a crankshaft 65. The crankshaft 65 connects to the rear wheel 20 via the transmission 30 and a drive linkage such as a chain, belt or shaft to allow the rear wheel 20 to rotate in response to combustion within the combustion chamber 55. In addition, most transmissions 30 include a neutral position that allows the engine 25 to operate without rotating the rear wheel 20.

Figure 3:
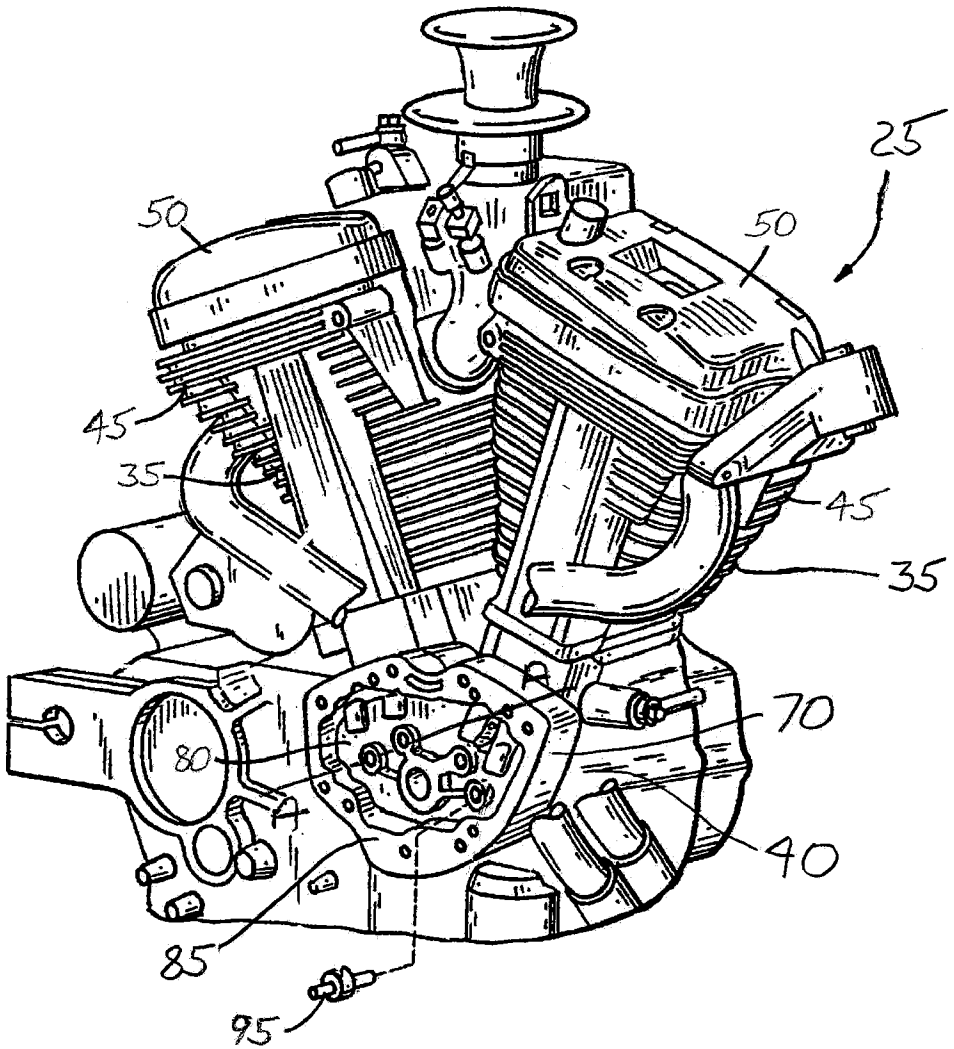
FIG. 3 is a perspective view of the engine of FIG. 2 with an oil pump assembly removed.

The crankcase 40, illustrated in FIG. 3, includes a housing 70 that defines cylinder attachment faces for each of the cylinders 35. The crankcase 40 also at least partially defines a crank chamber 75 (see FIG. 2) and a cam chamber 80 (see FIG. 3). An oil pump face 85 that is substantially normal to the cylinder attachment faces surrounds the cam chamber 80 and defines an attachment surface for an oil pump assembly 90. The oil pump assembly 90 (shown in FIG. 4) attaches to the oil pump face 85 and substantially closes the cam chamber 80.

A first cam shaft 95 and a second cam shaft (not shown) are supported for rotation substantially within the cam chamber 80 of the crankcase 40 and extend at least partially into the oil pump assembly 90 when the oil pump assembly is coupled to the crankcase 40. Each cam shaft 95 is coupled to the crankshaft 65 such that the cam shafts 95 rotate in response to rotation of the crankshaft 65 at a speed that is directly proportional to the speed of the crankshaft 65. In preferred constructions, a timing belt interconnects the crankshaft 65 and the cam shafts 95 to achieve the desired rotation. Each cam shaft 95 supports one or more cams that actuate one or more valves to admit a fuel-air mixture into the combustion chamber 55 of one of the cylinders 35 or to allow for the discharge of exhaust gases from the combustion chamber 55, as is known in the art.

Figure 4:
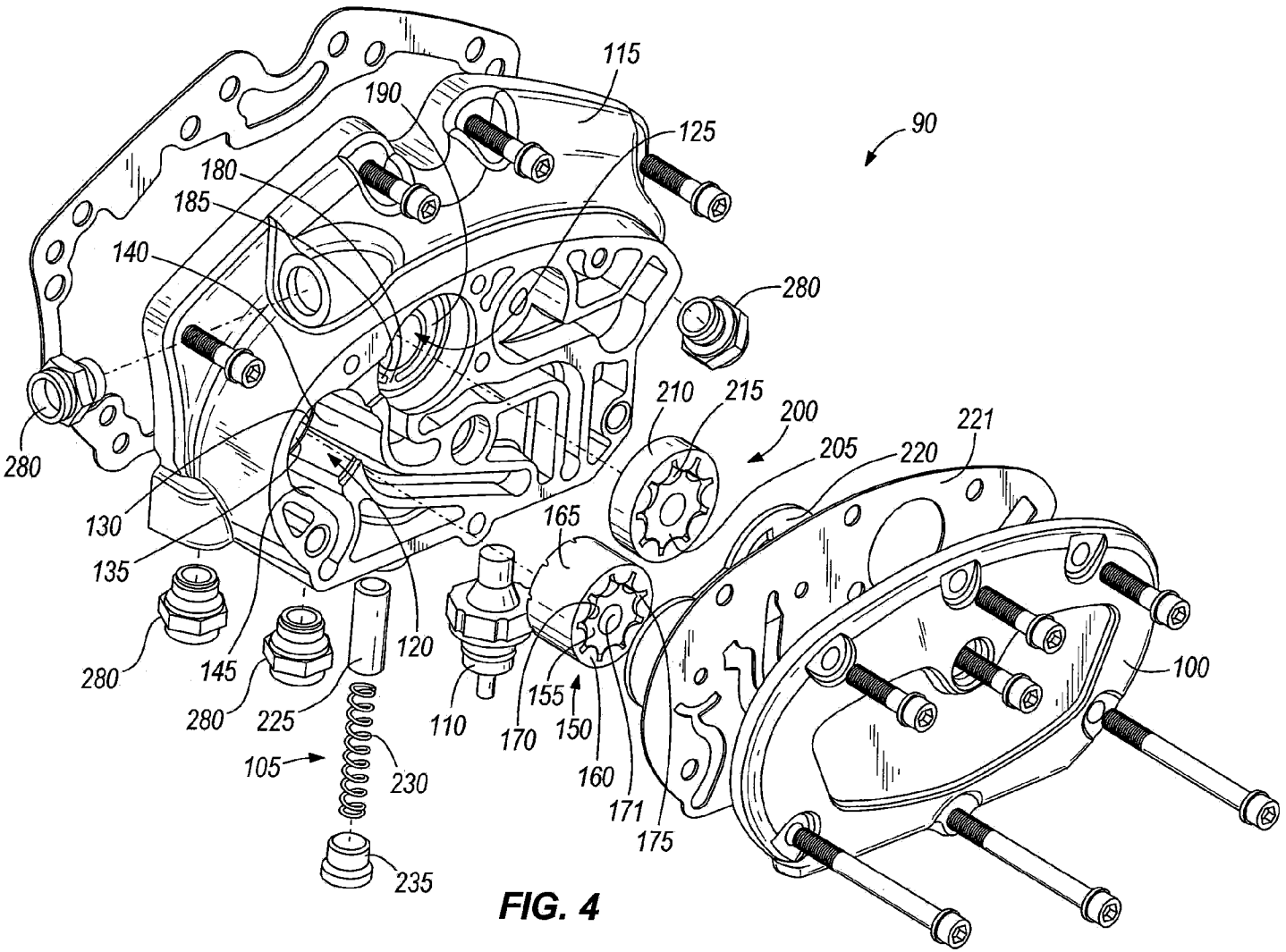
FIG. 4 is an exploded view of a pump assembly.

Turning to FIG. 4, the oil pump assembly 90 is illustrated in an exploded condition. The oil pump assembly 90 includes a pump cover 100, a bypass valve 105, a pressure sensor 110, a pump body 115 that defines a scavenge aperture 120 and a lube oil aperture 125, and a plurality of flow paths that will be discussed with regard to FIG. 5. The scavenge aperture 120 is substantially cylindrical and defines a substantially planar bottom surface 130 (shown in FIG. 5). A first aperture 135 is formed in the planar surface 130 and provides for fluid communication between an oil sump in the crank chamber 75 and the scavenge aperture 120. A second aperture 140 is formed as part of the cylindrical wall that defines the scavenge aperture 120 and provides for fluid communication between a sump in the cam chamber 80 and the scavenge aperture 120. A third aperture 145 is formed in the planar surface 130 and provides for fluid communication between the scavenge aperture 120 and an oil reservoir 148 such as an oil tank, a hollow structural member, or another container.

A scavenge gerotor 150 is disposed within the scavenge aperture 120 and includes a first inner rotor 155 and a first outer rotor 160. The first outer rotor 160 includes a cylindrical surface 165 that fits within the scavenge aperture 120 and allows the first outer rotor 160 to rotate with respect to the pump body 115. The first outer rotor 160 also includes an internal space 170 defined by a plurality of teeth-receiving apertures. The first inner rotor 155 includes a central aperture 171 that engages the first cam shaft 95 such that the first inner rotor 155 rotates with the first cam shaft 95. The first inner rotor 155 includes a plurality of teeth sized and shaped to fit within the teeth-receiving apertures of the outer rotor 160 such that the outer rotor 160 rotates in response to rotation of the inner rotor 155. The rotational axis AA of the first cam shaft 95 is offset slightly from the center of the scavenge aperture 120 such that as the first outer rotor 160 rotates around the inner rotor 155, gaps 175 open and close between the inner rotor 155 and the outer rotor 160, as is well known in the gerotor art.

The lube oil aperture 125 is substantially cylindrical, is shallower than the scavenge aperture 120, and defines a substantially planar bottom surface 180. An intake aperture 185 is formed in the planar bottom surface 180 and provides fluid communication between the oil reservoir 148 and the lube oil aperture 125. An outlet aperture 190 is formed in the planar bottom surface 180 and provides for fluid communication between the lube oil aperture 125 and an oil filter 195. The lube oil aperture 125 receives a lube oil gerotor 200 that is similar to the scavenge gerotor 150 in that it includes a second inner rotor 205 and a second outer rotor 210. The second outer rotor 210 fits within the lube oil aperture 125 but remains free to rotate with respect to the pump body 115. The second inner rotor 205 includes a central aperture that receives the second cam shaft such that the second inner rotor 205 rotates with the second cam shaft. Rotation of the second inner rotor 205 produces a corresponding rotation of the second outer rotor 210 such that gaps 215 between the inner and outer rotors 205, 210 open and close at predefined locations around the lube oil aperture 125.

As can be seen, the scavenge gerotor 150 is substantially thicker than the lube oil gerotor 200. The increased thickness provides additional pumping capacity for the scavenge gerotor 150 that may be needed to draw lubricant upward from the sumps. In other constructions, the scavenge gerotor 150 and the lube oil gerotor 200 may be of similar thickness.

Figure 6:
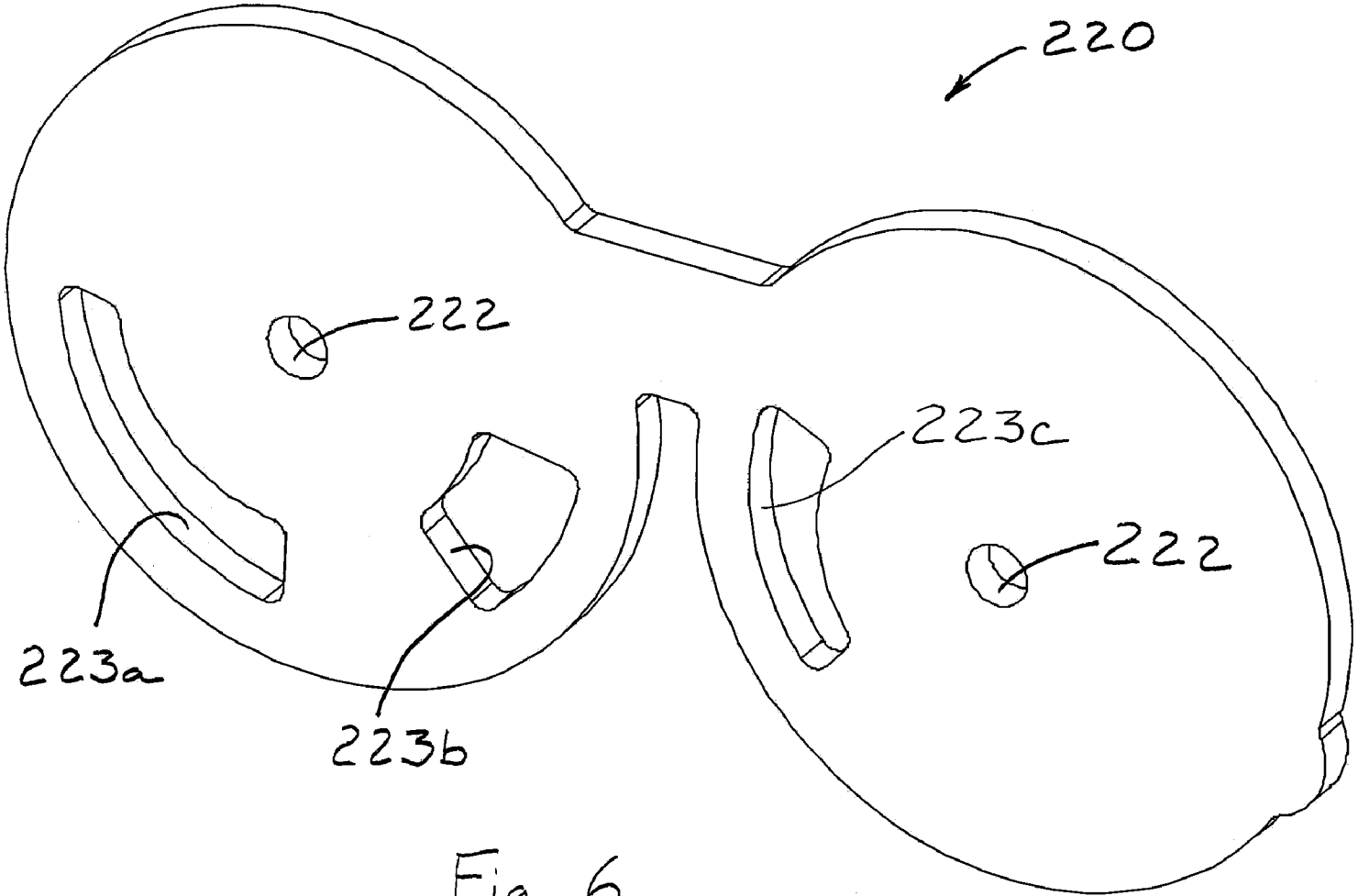
FIG. 6 is a perspective view of a separator plate of the pump assembly of FIG. 4.

In some constructions, a separator plate 220 (shown in FIG. 6) covers the exposed end faces of the gerotors 150, 200 to inhibit leakage out of the gerotors 150, 200 in an axial direction. The separator plate includes two circular apertures 222 and three flow apertures 223*a*, 223*b*, and 223*c*. The circular apertures 222 allow for the lubrication of the cam shafts. The first flow aperture 223*a* allows for suction flow into the scavenge gerotor 150 from the crankcase sump 236. The second aperture 223*b* allows for suction flow into the scavenge gerotor 150 from the cam chamber sump 237. The third aperture 223*c* allows for suction flow into the lube oil gerotor 200. Of course other constructions may rely on features other than the separator plate 220 to inhibit this unwanted leakage. The pump cover 100 attaches to the pump body 115 to close any exposed flow paths, to inhibit unwanted axial movement of the components, and to retain the separator plate 220 in the desired position. In some constructions, a gasket 221 may be positioned between the pump body 115 and the pump cover 100 to improve the seal therebetween.

With continued reference to FIG. 4, the bypass valve 105 includes a valve plunger 225, a biasing member 230, and a plug 235. The plunger 225 fits within an aperture that is formed in the pump body 115 and is movable between a closed position and an open or bypass position. The biasing member 230, in the form of a compression spring, engages the valve plunger 225 and biases it toward the closed position. The plug 235 engages the pump body 115 to close the aperture, and provides a surface that engages the biasing member 230. In some constructions, the plug 235 includes an o-ring, a gasket, or other sealing device that enhances the ability of the plug 225 to seal the aperture and inhibit oil leakage.

The pressure sensor 110 attaches to the pump body 115 and includes a pressure-sensing element that is in fluid communication with the lubricant within the pump body 115 as will be discussed with regard to FIG. 5. In preferred constructions, the pressure sensor 110 includes a pressure switch that is set to switch when a drop in pressure below a predetermined value occurs. If the pressure drops below a predetermined value, the switch actuates to activate an indicator such as a warning light for the operator. Thus, the pressure sensor 110 can be used to warn the motorcycle 10 operator of low lubricant pressure conditions that may be harmful to the engine 25.

Figure 5:
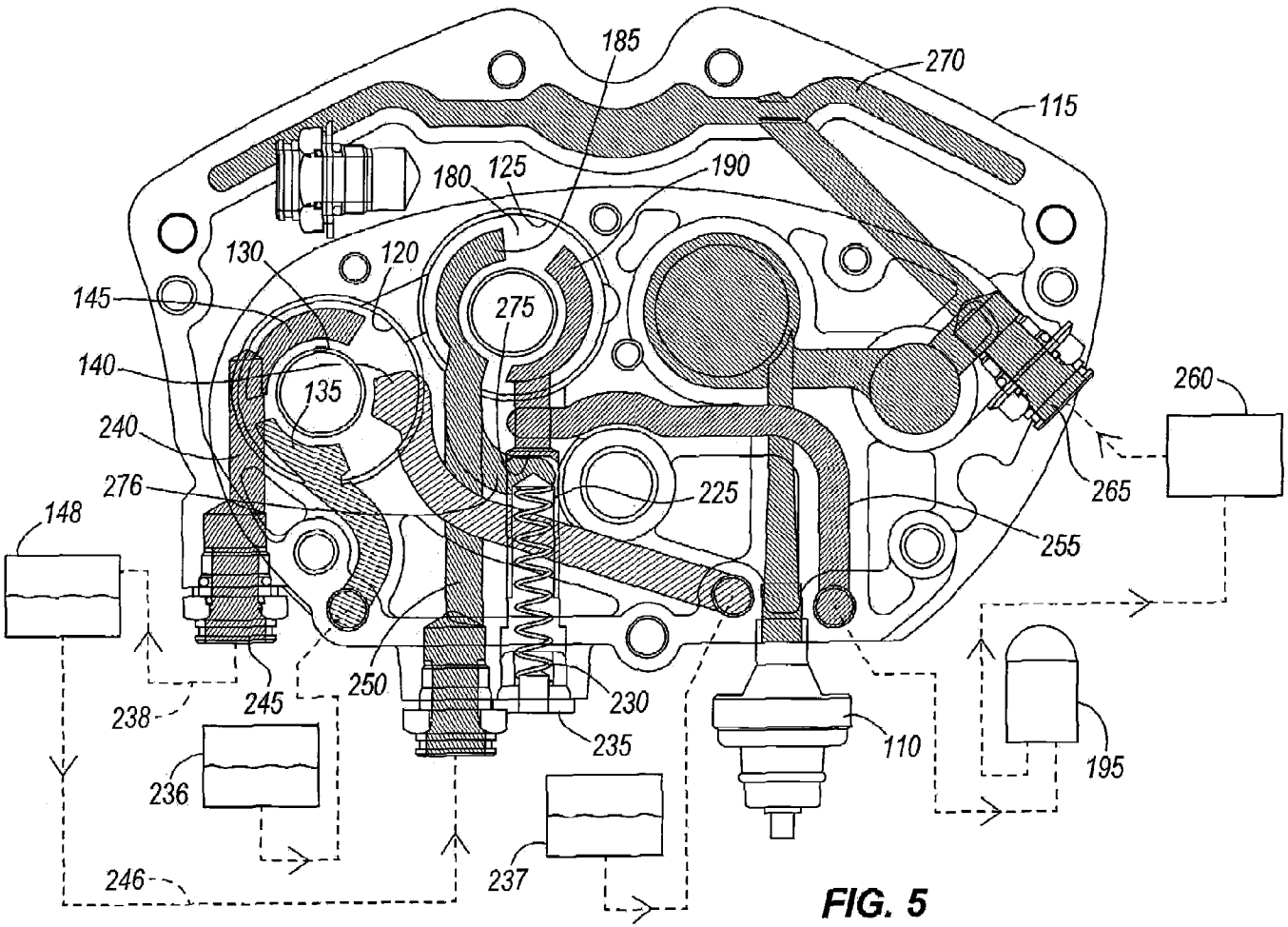
FIG. 5 is front view of the oil pump assembly illustrating the various flow paths.

With reference to FIG. 5, the various flow paths and operation of the oil pump assembly 90 will be described. During engine operation, the crankshaft 65 rotates in response to combustion within the combustion chambers 55. The rotation of the crankshaft 65 causes rotation of the cam shafts 95, which in turn causes rotation of both the scavenge gerotor 150 and the lube oil gerotor 200. As the scavenge gerotor 150 rotates, the first inner and first outer rotors 155, 160 begin to separate adjacent the first aperture 135 and adjacent the second aperture 140. The scavenge gerotor 150 produces a partial vacuum as the space between the first inner rotor 155 and the second inner rotor 160 increases. The partial vacuum draws oil, or other fluids (e.g., air), from the crankcase sump 236 through aperture 135 and from the cam chamber sump 237 through aperture 140 into the space between the first inner rotor 155 and the first outer rotor 160. Continued rotation of the gerotor 150 directs the fluid trapped in the space to the third aperture 145. From the third aperture 145, the fluid flows along a first internal flow path 240 that is formed within the pump body 115 to a first body outlet 245. From the first body outlet 245, the fluid flows through a conduit 238, such as an oil line to the oil reservoir 148. Thus, the scavenge gerotor 150 functions to draw oil, or other fluids, from collection points within the engine 25 and deliver that fluid to the oil reservoir 148 where it can be reused to lubricate and cool engine components.

The lube oil gerotor 200 is oriented such that the second inner rotor 205 and the second outer rotor 210 begin separating in the area over the intake aperture 185. As the rotors 205, 210 separate, a partial vacuum is created, which draws fluid from the oil reservoir 148, through an external oil line 246 or other flow path, and through a second internal flow path 250. The fluid rotates around the lube oil aperture 125 with the second rotors 205, 210 until the lubricant is adjacent the outlet aperture 190. As the space between the second inner rotor 205 and second outer rotor 210 approaches the outlet aperture 190, the second inner rotor 205 and the second outer rotor 210 move closer to one another, thus reducing the volume between them. As the volume is reduced, the fluid is forced through the outlet aperture 190 and into a third internal flow path 255.

The third internal flow path 255 is at least partially formed in the crankcase 40 and leads to the oil filter 195. The oil filter 195 removes small particles and substances that may be harmful to the engine components. From the filter 195, the oil flows into an oil cooler 260 that includes a heat exchanger that cools the oil. The cooled oil is better suited to cool and lubricate the moving components of the engine 25. From the oil cooler 260, the oil reenters the pump body 115 via a first body inlet 265, and flows through a series of lubrication channels 270 that direct the oil to the locations were lubrication and cooling is desired. For example, the oil can be directed to bearings that support the crankshaft 65 and/or bearings that support the cam shafts 95 to provide the desired lubrication and cooling. The directly driven gerotors 150, 200 provide sufficient flow capacity and pressure output to allow pressurized lubrication at these bearings. After lubricating the desired components, the oil collects in one of the crankcase sump and the cam case sump for collection and reuse by the scavenge gerotor 150.

A bypass aperture 275, formed as part of the pump body 115, leads to a bypass flow path 276 between the third internal flow path 255 (lube oil gerotor outlet) and the second internal flow path 250 (lube oil gerotor intake), The bypass valve 105 is positioned such that the plunger 225 is biased to close the bypass aperture 275. However, when the force generated by the high-pressure lubricant in the third internal flow path 255 overcomes the force produced by the compression spring, the plunger 225 begins moving away from the bypass aperture 275. With the plunger 225 moving away from the bypass aperture 275, lubricant from the third internal flow path 255 is bypassed to the second internal flow path 250.

Generally, the discharge pressure of the scavenge gerotor 150 and the lube oil gerotor 200 is a function of engine speed with higher engine speeds producing higher discharge pressures. At high engine speeds, excess high-pressure lubricant is bypassed from the outlet of the lube oil gerotor 200 to the intake aperture 185 adjacent the lube oil gerotor 200, thereby holding the delivered flow constant at high speeds. The increased flow and pressure at the intake aperture 185 increases the cavitation speed of the lube oil gerotor 200 and therefore, could increase the volumetric efficiency of the gerotor 200 at these higher speeds.

As illustrated in FIG. 5, the pressure sensor 110 is in fluid communication with one of the series of lubrication channels 270 that direct lubricant to the points that require lubrication or cooling. As such, the pressure sensor 110 is able to detect a pressure drop in these flow paths 270. A pressure drop in these flow paths 270 could be harmful to the engine 25 as low-pressure would indicate that some or all of the moving parts may be receiving inadequate lubrication and cooling.

The arrangement of the oil pump assembly 90 illustrated herein allows for the use of a bypass valve 105 that allows for supercharging of the lube oil gerotor inlet. In addition, the directly driven gerotors 150, 200 have increased reliability over other mechanically driven oil pump arrangements and provide additional capacity that allows for direct pressurized lubrication of the bearings, rather than the more common splashed lubrication. Furthermore, the positioning of the apertures that lead into and out of the pump body 115 are such that straight fittings can be employed at all locations.

The oil pump assembly 90 illustrated herein includes several inlets and outlets that provide for connection between components external to the pump (e.g., oil cooler 260, oil filter 195, etc.). The arrangement of the pump assembly 90 is such that straight fittings 280 can be employed at all inlets and outlets, thereby eliminating the need for any angled fittings. The fittings 280 may include pipe fittings, compression fittings, hose fittings, and the like.

Thus, the invention provides, among other things, a new and useful oil pump assembly 90 for a motorcycle 10. More particularly, the invention provides a new and useful oil pump 90 that includes two gerotors 150, 200, each directly driven by one of the cam shafts 95. Various features and advantages of the invention are set forth in the following claims.

What is claimed is:

1. An oil pump for an engine having a first cam shaft and a second cam shaft, the oil pump comprising:

a housing;

a first pump assembly at least partially disposed within the housing, the first pump assembly including a rotating element that is adapted to be directly driven by the first cam shaft; and a second pump assembly at least partially disposed within the housing, the second pump assembly including a rotating element that is adapted to be directly driven by the second cam shaft.

2. The oil pump of claim 1, wherein the housing includes a first portion and a second portion attachable to the first portion.

3. The oil pump of claim 2, wherein the first portion and the second portion cooperate to at least partially enclose an interior of the housing and each of the first portion and the second portion define a portion of an external surface of the housing.

4. The oil pump of claim 1, wherein the housing at least partially defines a first aperture sized to receive the first pump assembly and a second aperture sized to receive the second pump assembly.

5. The oil pump of claim 1, wherein the housing at least partially defines an inlet flow path, an outlet flow path and a bypass flow path, and wherein rotation of the second rotating element draws fluid from the inlet flow path and discharges the fluid to the outlet flow path.

6. The oil pump of claim 5, further comprising a bypass valve coupled to the housing and movable between a first position in which the discharged fluid flows along the outlet flow path and a second position in which at least a portion of the discharged fluid flows along the bypass flow path to the inlet flow path.

7. The oil pump of claim 1, wherein the first pump assembly includes a gerotor and the second pump assembly includes a gerotor.

8. The oil pump of claim 1, wherein the housing at least partially defines a sump, and wherein the first pump assembly draws fluid from the sump and directs the fluid out of the housing.

9. The oil pump of claim 1, wherein the first cam shaft and the second cam shaft are at least partially supported for rotation by bearings, and wherein the second pump assembly delivers a flow of pressurized fluid to at least one of the bearings.

10. An oil pump for an engine having a first cam shaft, a second cam shaft, and a crankcase, the oil pump operable to draw oil from a source and deliver the oil to the crankcase for lubrication, the oil pump comprising:

a pump body at least partially defining a pump aperture, an inlet path, an outlet path, and a bypass flow path;

a pump assembly at least partially disposed in the pump aperture and operable to draw fluid from the inlet path and discharge fluid to the outlet path, the pump assembly including a rotating element that is directly driven by the first cam shaft; and a bypass valve coupled to the pump body and movable between a first position in which the discharged fluid flows along the outlet path and a second position in which at least a portion of the discharged fluid flows along the bypass flow path to the inlet path, wherein the pump body at least partially defines a second aperture sized to receive a second pump assembly.

11. The oil pump of claim 10, further comprising a cover coupled to the pump body to define an interior and an exterior surface.

12. The oil pump of claim 11, wherein the cover and the pump body cooperate to at least partially enclose the interior and each of the cover and the pump body define a portion of the external surface.

13. The oil pump of claim 10, wherein the second pump assembly includes a second rotating element that is directly driven by the second cam shaft.

14. The oil pump of claim 10, wherein the pump assembly includes a gerotor and the second pump assembly includes a gerotor.

15. The oil pump of claim 10, wherein the first cam shaft and the second cam shaft are at least partially supported for rotation by bearings, and wherein the pump assembly delivers a flow of pressurized fluid to at least one of the bearings.

16. An oil pump for an engine having an external surface, a cam shaft, a crankcase, and an oil pump operable to draw oil from a source and deliver the oil to the crankcase for lubrication, the oil pump comprising:

a pump body at least partially defining a pump aperture, an inlet path, an outlet path, and a bypass flow path;

a pump assembly at least partially disposed in the pump aperture and operable to draw fluid from the inlet path and discharge fluid to the outlet path, the pump assembly including a rotating element that is directly driven by the cam shaft; and a cover having a first surface and a second surface opposite the first surface, the first surface cooperating with the pump body to at least partially close the inlet path, the outlet path, and the bypass flow path, the second surface and the pump body each defining a portion of the external surface.

17. The oil pump of claim 16, further comprising a second pump assembly, and wherein the housing at least partially defines a first aperture sized to receive the pump assembly and a second aperture sized to receive the second pump assembly.

18. The oil pump of claim 17, wherein the pump assembly includes a gerotor and the second pump assembly includes a gerotor.

19. The oil pump of claim 17, wherein the engine includes a second cam shaft, and wherein the cam shaft and the second cam shaft are at least partially supported for rotation by bearings, and wherein the pump assembly delivers a flow of pressurized fluid to at least one of the bearings.

20. The oil pump of claim 16, further comprising a bypass valve coupled to the pump body and movable between a first position in which the discharged fluid flows along the outlet path and a second position in which at least a portion of the discharged fluid flows along the bypass flow path to the inlet path.

* * * * *